US005092548A

United States Patent [19]

Bayes et al.

[11] Patent Number: 5,092,548

[45] Date of Patent: Mar. 3, 1992

[54] DEVICE FOR HOLDING BAGS

[75] Inventors: Richard M. Bayes, Cincinnati, Ohio; Dennis B. Brashear, Louisville, Ky.

[73] Assignee: Tara Plastics Corporation, Forest Park, Ga.

[21] Appl. No.: 486,344

[22] Filed: Feb. 28, 1990

[51] Int. Cl.[5] ..... B65B 67/00

[52] U.S. Cl. ..... 248/99; 248/95; 248/100

[58] Field of Search ..... 248/95, 97, 98, 99, 248/100, 101; 220/404

[56] References Cited

U.S. PATENT DOCUMENTS

| | | | |
|---|---|---|---|
| 490,578 | 1/1893 | Merry | 248/99 |
| 575,403 | 1/1897 | Morton | 248/100 |
| 992,445 | 5/1911 | Parson | 248/99 |
| 2,401,969 | 6/1946 | Schlank | 248/100 X |
| 4,487,388 | 12/1984 | Provan | 248/99 X |
| 4,498,652 | 2/1985 | Malik | 248/99 |
| 4,579,307 | 4/1986 | Malik | 248/99 |
| 4,840,336 | 6/1989 | Stroh et al. | 248/97 |

*Primary Examiner*—David L. Talbott
*Attorney, Agent, or Firm*—Needle & Rosenberg

[57] ABSTRACT

A device for holding an assembly of T-shirt type bags on a mounting surface, each bag having two shoulders, collar and an attachment opening. The device has a shoulder supporting bar having a first subsection over which the first of the shoulders may be draped and a second subsection over which the second of the shoulders may be draped, a bag separating member provided between the first and second subsections and having an upper region over which the attachment openings may be placed to support the bags and a forward facing lower region contacting and forcing forward the collar, and means for mounting the device on the mounting surface.

10 Claims, 3 Drawing Sheets

DEVICE FOR HOLDING BAGS

BACKGROUND OF THE INVENTION

The present invention relates to an improved device for holding bags, and particularly "T-shirt type" plastic bags which are commonly found in retail establishments.

The vast majority of retail establishments supply bags to their customers for carrying their purchases from the stores. One common type of bag is known as a "T-shirt" bag, and is typically made of a thin plastic material. In the past, bags have been provided to the retailers in stacks, and the retailers have typically placed the bags in a cubby or some other compartment near the checkout counters. A problem existing with such loose packaging of bags is that the bags, and particularly plastic bags, tend to stick together and it is often time consuming for the person working at the counter to remove individual bags. Also, the bags tend to be pushed around and create a disorderly appearance behind the counter. To overcome this problem, it has been known in some instances to attach a large number of bags to a cardboard backing, so that the person at the checkout counter can simply pull a bag off of the pile when needed. However, again the problem of bags sticking to each other arises and cashiers spend a costly amount of time trying to separate the outermost bag from the remaining bags of the stack.

Therefore, there exists a need for a device which will hold bags in an orderly fashion and which will allow a counter person to remove a single bag quickly and efficiently.

SUMMARY OF THE INVENTION

The present invention relates to a device for holding an assembly of T-shirt type bags on a mounting surface, such as the underside of a counter or a wall.

The standard T-shirt type bag has two shoulders, a collar between the shoulders and an attachment opening at the approximate midpoint of the collar. A plurality of bags are attached at attachment loops to form an assembly.

The device preferably includes a mounting plate for mounting the device to the mounting surface, a U-shaped extension bar having arms extending perpendicularly from the mounting plate, a shoulder supporting bar provided across the arms of the extension bar, and a bag separating member supported on both the face of the U-shaped extension bar and the middle length of the shoulder supporting bar. The bag separating member is preferably a ring having an upper region over which the bag attachment openings may be placed to support the bags and a forward facing lower region.

In operation, the upper region of the bag separating member holds the bag assembly in place, and the shoulders of the bags are draped over the shoulder supporting bar. The lower region of the bag separating member contacts and forces the collars of the bags forward, thereby enabling the forward-most bag to be easily grasped and separated from the assembly by downward force.

Therefore, there exists a need for a device which will hold bags in an orderly fashion and which will allow a counter person to remove a single bag quickly and efficiently.

DETAILED DESCRIPTION OF THE DRAWINGS

DETAILED DESCRIPTION OF THE INVENTION

Figure 1:
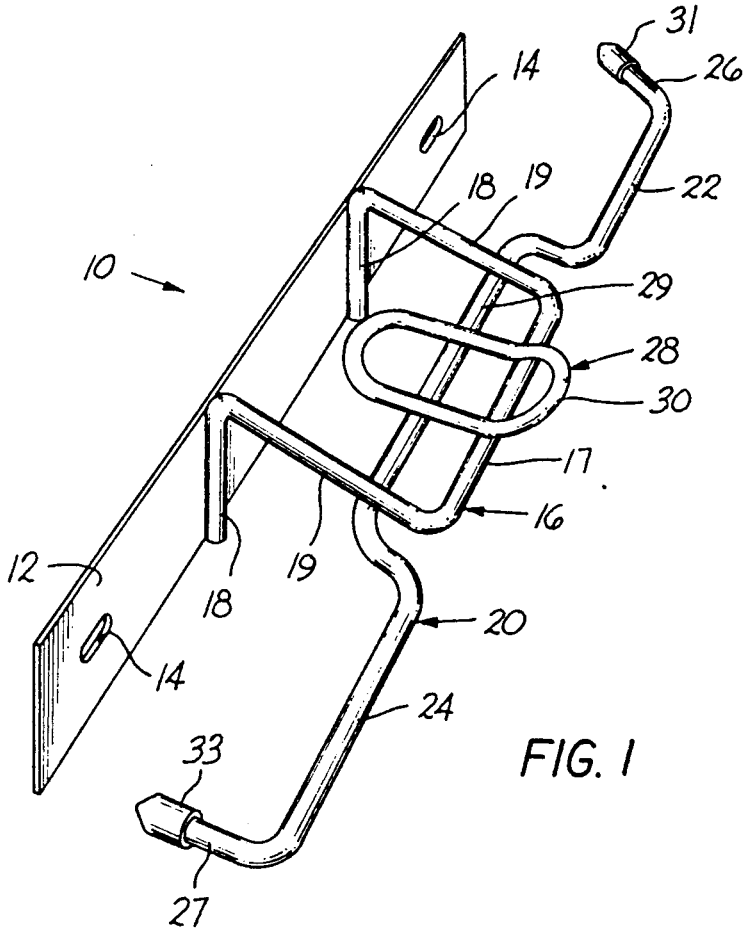
FIG. 1 is a perspective view of one embodiment of the present invention for holding "T-shirt" bags.
Figure 2:
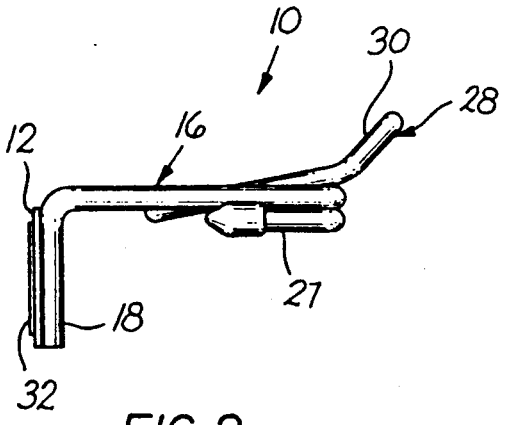
FIG. 2 is a first side view of the embodiment of the present invention shown in FIG. 1.
Figure 3:
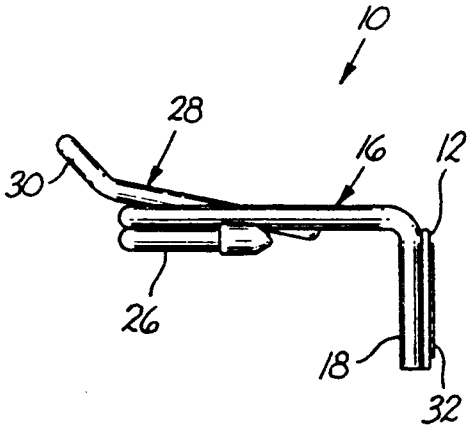
FIG. 3 is a second side view of the embodiment of the present invention as shown in FIG. 1.
Figure 4:
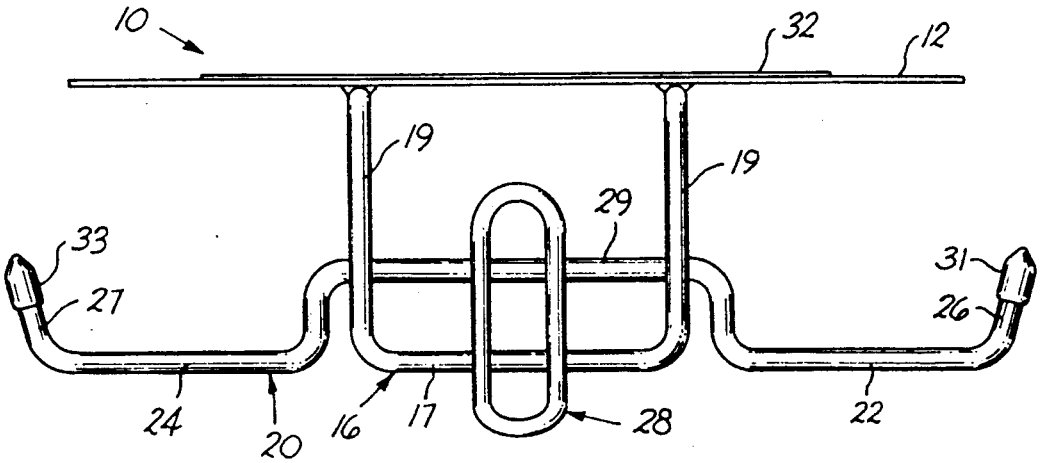
FIG. 4 is a top view of the embodiment of the present invention as shown in FIG. 1.
Figure 5:
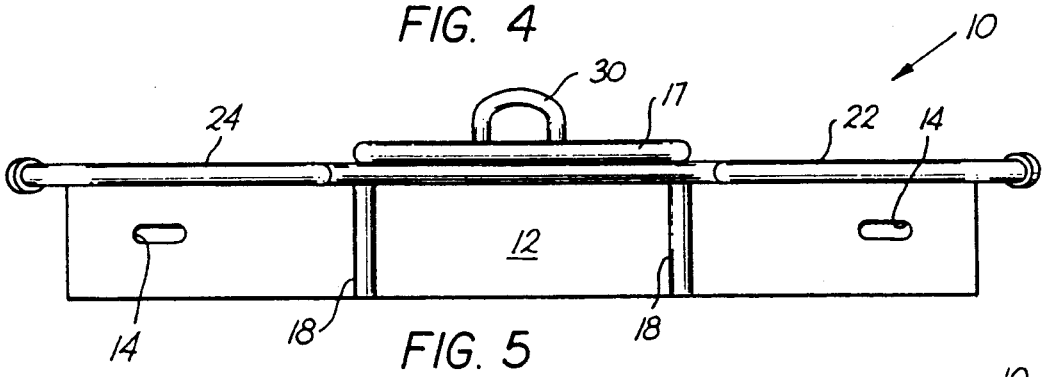
FIG. 5 is a front view of the embodiment of the present invention as shown is FIG. 1.
Figure 6:
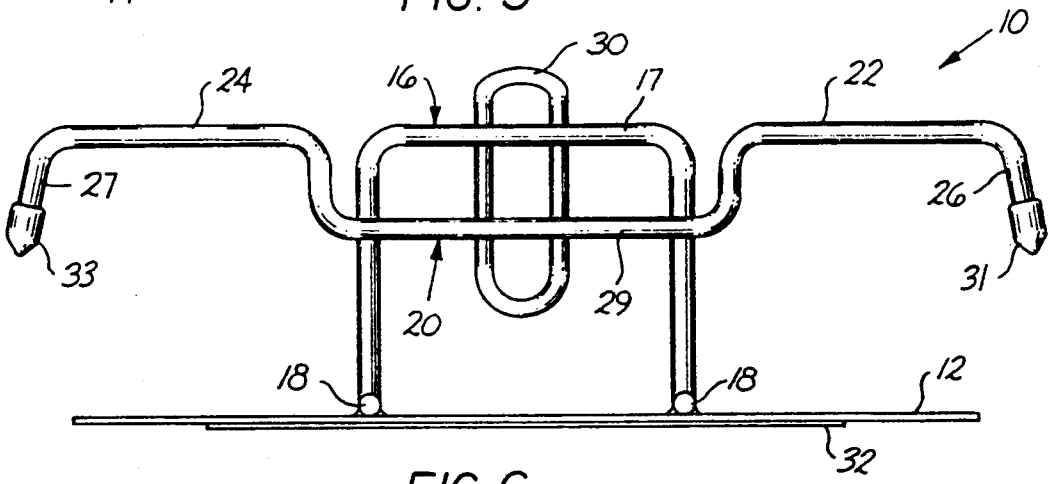
FIG. 6 is a bottom view of the embodiment of the present invention as shown in FIG. 1.
Figure 7:
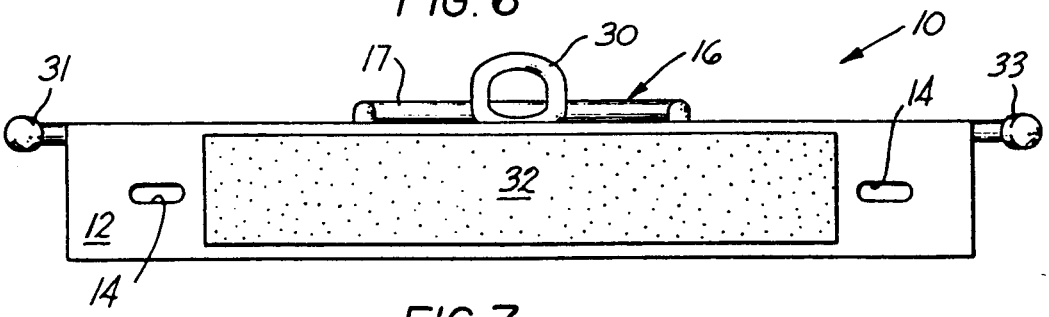
FIG. 7 is a rear view of the embodiment of the present invention as shown in FIG. 1.
Figure 8:
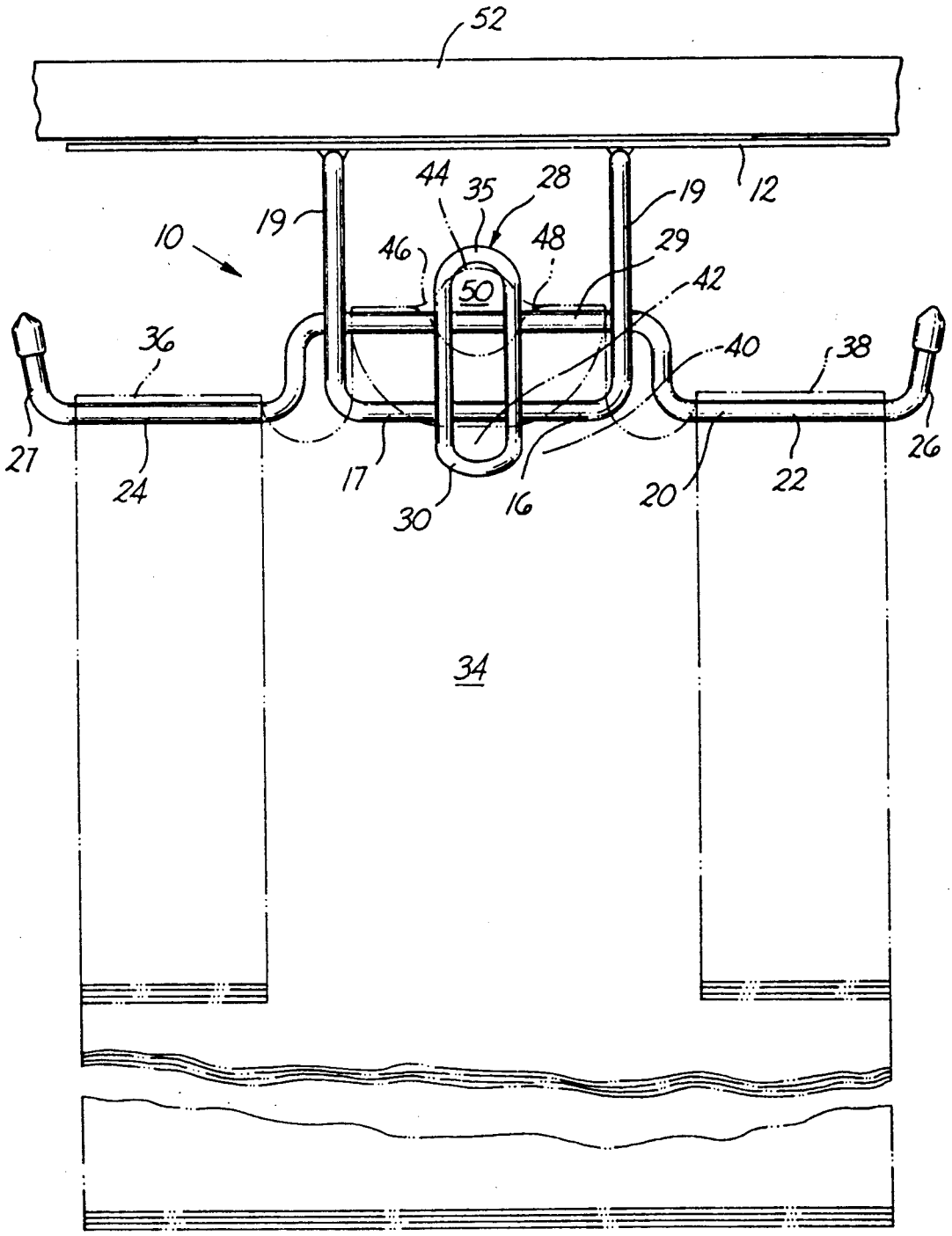
FIG. 8 is a front view of the present invention attached counter top and holding a plurality of T-shirt type bags.

The device 10 of the present invention, as shown as one embodiment in FIGS. 1-8, provides means for storing bags, preferably T-shirt type bags, in a manner in which the bags may be easily removed. The device 10 preferably includes a mounting plate 12 which may be attached to a horizontal surface beneath a counter top 52, such as shown in FIG. 8, or to a vertical surface such as a wall. The device 10 will typically be placed adjacent a cashier. The mounting plate 12 has mounting holes 14 within its body for receiving screws or other attachment means for attaching the plate 12 to the surface. An adhesive backing 32 on the rear side of the mounting plate 12 may be used for reinforcement when attaching the plate 12 to the surface. A first member, such as a U-shaped extension bar 16, extends, by means of arms 19, perpendicularly from one side of the mounting plate 12 such that the face 17 of the U-shaped bar 16 extends outward from the plate 12 The U-shaped bar 16 is preferably comprised of a thick gauged metal bar, and has bar supports 18 extending from each of its distal ends. The U-shaped bar 16 may be spot welded along the bar supports 18 to the mounting plate 12, or attached by other means.

A second member, such as a shoulder supporting bar 20, is attached to the U-shaped bar 16 and extends parallel to the longitudinal plane of the mounting plate 12. The shoulder bag supporting bar 20 preferably has a first subsection 22 lying parallel to the mounting plate 12 having a distal end 26 extending toward the mounting plate 12 and a second subsection 24 extending from the opposite side of the U-shaped bar 16 and parallel to the mounting plate 12 having a distal end 27 extending toward the mounting plate 12. The shoulder bar 20 also has a U-shaped midportion 29 extending in a direction towards the mounting plate 12. The shoulder supporting bar 20 is preferably comprised of a strong gauge metal bar. The shoulder supporting bar 20 is attached to the U-shaped bar 16 at the midportion 29 so that the distal ends 26 and 27 face toward the mounting plate 12, and so that the midportion 29 and the face 17 of the U-shaped bar 16 form a "box-like" structure. The distal ends 26 and 27, preferably, are covered by caps or tip covers 31 and 33, respectively.

A bag separating member 28 is attached to both the midportion 29 of the bag supporting bar 20 and the face 17 of the U-shaped bar 16. The separating member 28 is preferably an elongated ring having a lower region 30 extending beyond the face 17 of the U-shaped bar 16 as well as beyond the plane of the subsections 22 and 24 of the horizontal bar 20, and an upper region 35 located between the midportion 29 and the mounting plate 12. The lower region 30 is outwardly extending, preferably at an angle of about 45° to the plane formed by the U-shaped bar 16 and the shoulder bar 20.

As seen in FIG. 8, the typical T-shirt type bag 34 has a pair of shoulders 36, 38 separated by a bag middle portion 40, or "collar". A tab member 42 is provided at the approximate center of the middle portion. An attachment loop 44 is connected at each end 46, 48 to opposite sides of the tab member 42, thereby forming attachment opening 50. An assembly of bags 34 is formed by attaching a plurality of bags 34 along their respective attachment loops 44, such as by heat sealing or other means.

In operation, as best seen in FIG. 8, the device 10 is attached to the underside of a counter 52. The assembly of bags 34 are placed onto the device 10 by placing the attachment loop 44 over the upper region 35 of the separating member 28 and allowing the bags 34 to hang towards the floor. The shoulders 36, 38 of the bags 34 are draped over the first and second subsections 22, 24 and the tab members 42 will be forced forward from the remaining portions of the bags 34. This in turn will result in the forward-most bag 34 of the assembly being slightly raised above the next preceding bag 34. In this manner, the forward-most bag 34 can be easily grasped and removed from the assembly by applying downward force. This procedure can be repeated for each bag 34 of the assembly.

Alternatively, the device 10 may be attached to a vertical surface, wherein the tab 42 will be forced upward from the lower region 30 of the supporting member 28. However, the device 10 will operate essentially in the same manner. Similarly, as shown in FIG. 9, the device 10 may have the mounting plate 12 attached to the bar supports 18 in such a manner that it is parallel to the longitudinal plane of the horizontal supporting bar 20. This will allow the separating member 28 to be held in vertical position while the device 10 is attached to a vertical surface.

While the above description contains many specificities, these should not be construed as limitations on the scope of the invention but rather as an application of preferred embodiments thereof.

What is claimed is:

1. A device for holding an assembly of T-shirt type bags on a mounting surface, each bag having two shoulders, a collar and an attachment opening, the device comprising:

(a) a shoulder supporting bar having a first subsection over which the first of the shoulders may be draped and a second subsection over which the second of the shoulders may be draped wherein said first and second subsections are generally parallel to said mounting surface and each subsection has an outer section extending toward said mounting surface;

(b) a bag separating member provided between said first and second subsections and having an upper region over which the attachment openings may be placed to support the bags and a forward facing lower region contacting and forcing forward the collar; and (c) means for mounting said device on the mounting surface.

2. The device of claim 1, wherein said bag separating member is provided on said shoulder supporting bar between said first and second subsections.

3. The device of claim 1, and further comprising an extension bar for extending said shoulder supporting bar a distance from the mounting surface.

4. The device of claim 3, wherein said extension bar is a U-shaped bar having a face and two arms, said U-shaped bar attached at its arms to the mounting surface.

5. The device of claim 4, wherein said shoulder extension bar is provided across the arms of said U-shaped bar approximately parallel to said face of said U-shaped bar.

6. The device of claim 4, wherein said bag separating member is supported on both said face and said shoulder extension bar.

7. The device of claim 1, wherein said bag separating member is a ring.

8. The device of claim 6, wherein said bag separating member is a ring supported on both said face and said shoulder extension.

9. The device of claim 3, and further comprising a mounting plate attached to said extension bar for mounting said device on the mounting surface.

10. The device of claim 1, wherein said lower region faces forward at an angle of approximately 45°.

* * * * *